United States Patent [19]

Smith

[11] 4,008,506

[45] Feb. 22, 1977

[54] PORTABLE DOCKS AND BRIDGES

[76] Inventor: Stuart D. Smith, 28430 Swan Drive, Grosse Ile, Mich. 48138

[22] Filed: July 30, 1975

[21] Appl. No.: 600,435

[52] U.S. Cl. ..... 14/71.1

[51] Int. Cl.[2] ..... E01D 15/12

[58] Field of Search ..... 14/2, 3, 4, 72, 14, 14/1, 36, 37; 52/645, 641, 693

[56] References Cited

UNITED STATES PATENTS

| | | | |
|---|---|---|---|
| 426,209 | 4/1890 | McIntyre | 14/72 |
| 1,358,951 | 11/1920 | Helmich | 14/71 X |
| 2,306,311 | 12/1942 | Holland | 52/645 X |
| 2,556,175 | 6/1951 | Frost | 14/37 X |
| 2,617,131 | 11/1952 | Harris | 14/71 |
| 2,828,497 | 4/1958 | Matthews | 14/71 |
| 2,851,311 | 9/1958 | Gibbs | 14/71 X |
| 3,735,440 | 5/1973 | Hetmanski | 14/71 |
| 3,795,333 | 3/1974 | Tebben | 14/71 X |

*Primary Examiner*—Nile C. Byers, Jr.
*Attorney, Agent, or Firm*—Fisher, Gerhardt & Groh

[57] ABSTRACT

A portable dock of sectional construction in which adjoining dock sections may be connected together by a pivot arrangement which allows the attachment of one dock section to the other without entry into the water over which the dock assembly is to extend. The pivot arrangement supports the dock section being added for pivotal movement from a prior installed dock section to a horizontal position extending in cantilevered relationship to the prior installed dock section. The pivot arrangement includes supporting surfaces which limit the extent of pivotal movement of one dock section relative to the other and also act to support the added dock section in cantilevered relationship.

15 Claims, 13 Drawing Figures

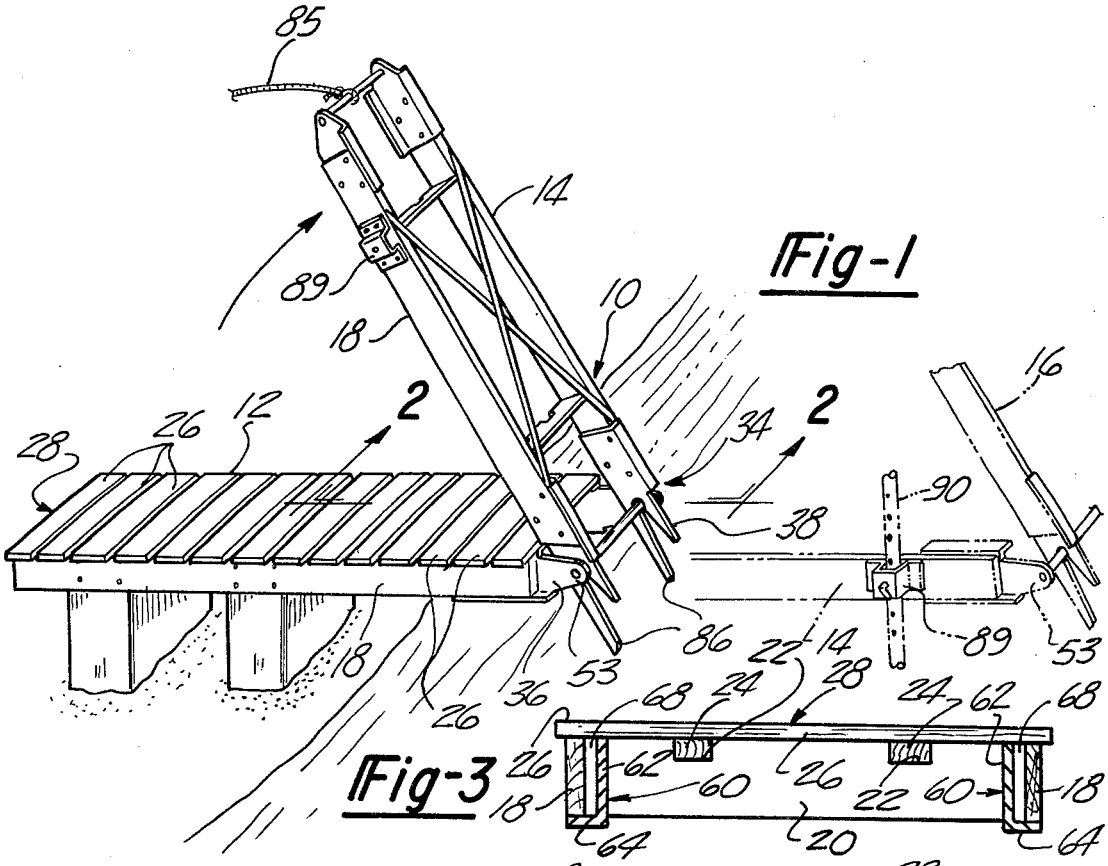
Fig-1
Fig-3
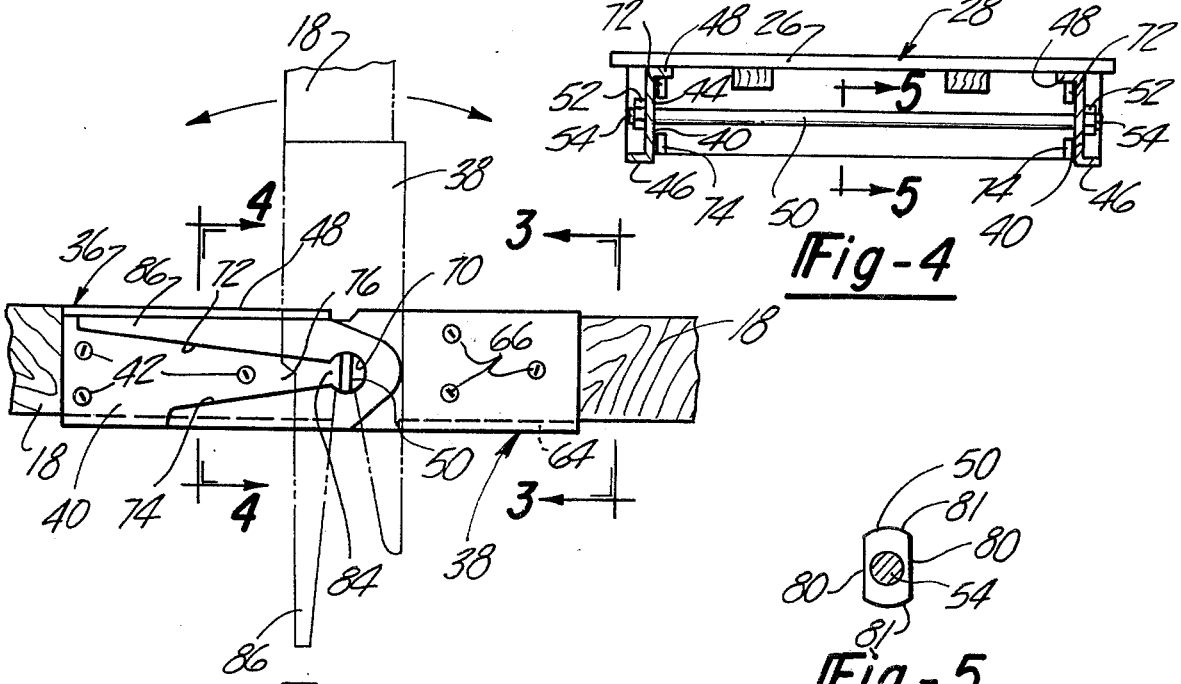
Fig-4
Fig-5
Fig-2

Fig-6
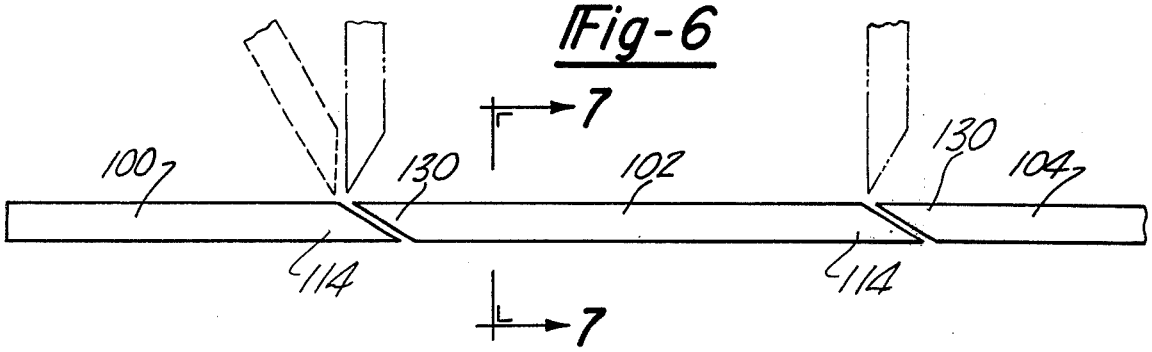
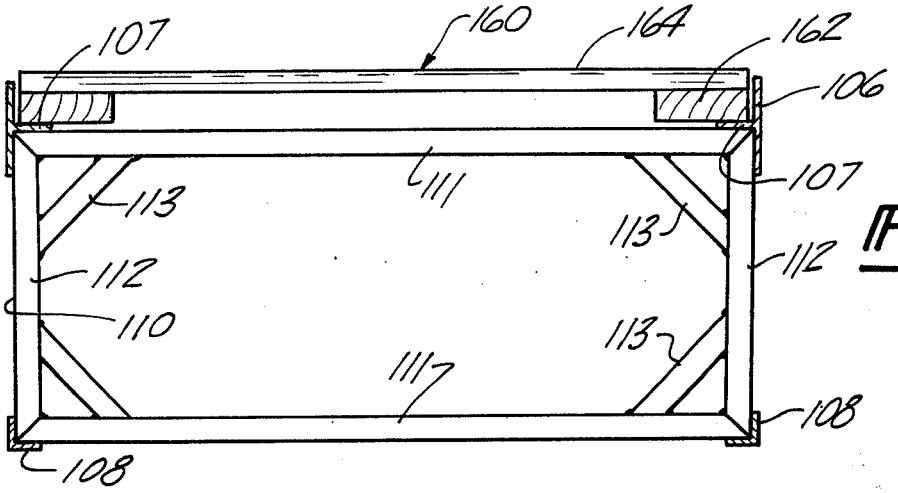
Fig-7
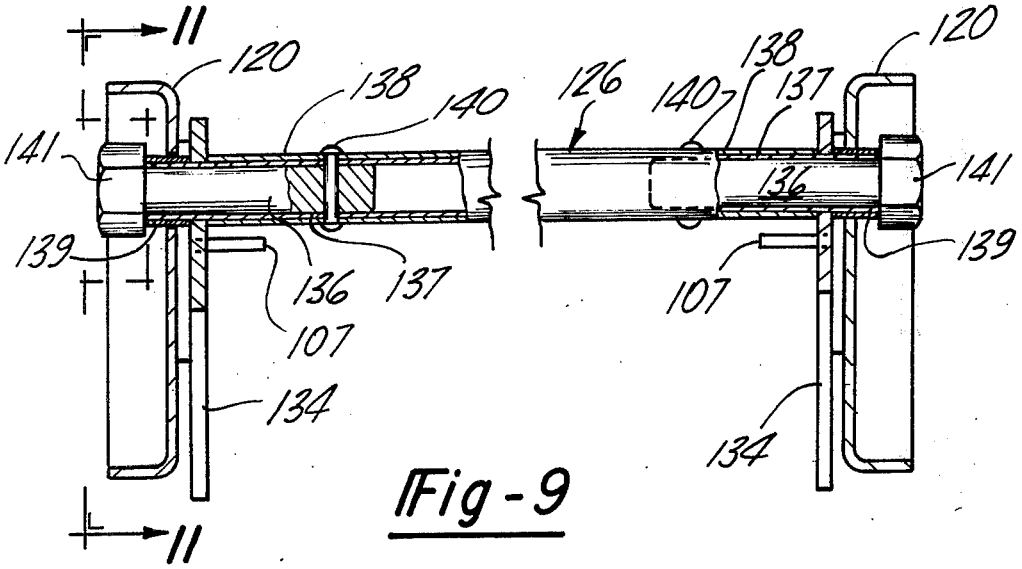
Fig-9

PORTABLE DOCKS AND BRIDGES

This invention relates to docks or piers of portable sectional type.

In certain geographic areas where bodies of water freeze, it is necessary to install docks or piers at the end of the winter season and remove them again before winter begins. The seasonal installation of such docks has resulted in the development of many forms of sectional docks which are installed in end-to-end relationship over the water, and are supported horizontally by various arrangements of posts or the like which engage the bottom of the body of water.

For the most part, such installations require the assistance of several people, some of whom must work in the water, which often is cold and uncomfortable. Attempts to develop docks which may be installed without requiring entry into the water by the installer have resulted in arrangements requiring special tools or special additional equipment, such as rollers, floats or booms which do not form a part of the dock structure after it has been installed. Such accessory equipment must be stored for availability when dock installation or removal is to take place, and furthermore, add to the cost and complexity of dock installation.

It is an object of the invention to provide a dock of portable sectional type in which installation may be made without use of special tools or accessory equipment and without entering the water at the site of installation.

It is a further object of the invention to provide a dock or bridge of sectional type in which adjacent sections are connected together, and the added section is supported from the prior section without requiring additional support to the bottom of the water body.

A portable dock or bridge of sectional type has been provided in which adjacent ends of adjoining dock sections are formed with complementary pivot elements which are detachably connectible to each other upon positioning of the dock sections being added relative to the dock section already installed. The dock section being added is installed from the prior dock section by connecting the pivot elements to each other and swinging the added dock section approximately 180° to a horizontal position. When adjoining dock sections are in horizontal connected relationship relative to each other, coacting support members limit movement of the dock section being added to the prior dock section and prevent pivoting below a horizontal plane relative to the prior dock section. In this manner, the dock section which is being added is disposed in a cantilever relationship to the prior dock section and an installer may walk out on the added dock section to install vertical supporting members for engagement with the water bottom, after which additional dock sections may be added. Each section, which is added is cantilevered relative to the prior section and is prevented from displacement relative to the prior dock section in either a longitudinal or transverse direction.

FIG. 1 is a perspective view of a dock installation embodying the invention;

FIG. 2 is a side view at an enlarged scale looking generally in the direction of the line 2—2 in FIG. 1;

FIG. 3 is a sectional view taken on line 3—3 in FIG. 2;

FIG. 4 is a sectional view taken on line 4—4 in FIG. 2;

FIG. 5 is a sectional view of a portion of the dock installation shown in FIG. 1 taken on line 5—5 in FIG. 4;

FIG. 6 is a diagrammatic side view of a modified form of the invention;

FIG. 7 is a cross-sectional view at an enlarged scale taken generally on line 7—7 in FIG. 6;

FIG. 9 is a cross-sectional view taken on line 9—9 in FIG. 8;

Figure 10:
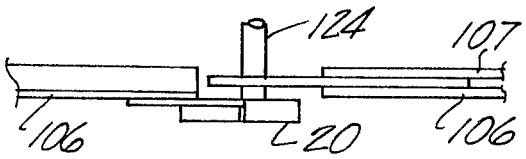
FIG. 10 is a top view of a portion of the structure shown in FIG. 8.

The portable dock of sectional construction embodying the invention is designated generally at 10 and for illustration purposes can be considered to include, a shore anchored section 12, and intermediate dock section 14 and an end dock section 16.

Each of the sections 12, 14 and 16 are generally of similar construction and each includes a pair of longitudinally extending side members 18, which may be of wooden construction, joined together by cross-members 20 extending generally transversely to the side members 18. The side members 18 and the cross-members 20 form the basic frame work for each dock section and may be fabricated of readily available lumber, for example, timbers or the like having a cross section of standard 2 × 6 inches or 2 × 8 inch dimension and having a length of approximately 8 to 10 feet. The cross-members may be formed of similar lumber material so that the overall spacing between the side members 18 is to the order of 30 inches.

The cross-member 20 have their upper surfaces notched as at 22 to receive longitudinal deck supporting members 24. The deck supporting members 24 are disposed in generally parallel relationship to each other and support transverse platform or deck members 26, which may be fabricated of lumber. In the assembled condition, each of the dock section frame members, which are formed by the side members 18 and the cross-members 20, receive a deck section 28 fabricated of a pair of longitudinal members 24 and transverse platform or deck members 26.

Adjoining ends of adjoining dock sections are connected together by pivot means or hinge assembly generally designated at 34. The hinge assembly 34 includes a pivot structure 36 and a pivot receiving structure 38 which are connected to adjacent ends of adjacent sections such as the section 12 and 14 or the section 14 and 16.

As best seen in FIGS. 2 and 4, the pivot structure 36 includes a pair of side brackets 40 which are adapted to be connected to the dock frame side members 18 by means of bolts or screws 42. Each of the side brackets has a generally Z-shaped cross section with a vertically disposed web 44 with a lower horizontal flange 46 and an upper horizontal flange 48. The side brackets 40 are connected to the pair of longitudinal side members 18 so that the web portions 44 are in engagement with facing surfaces of longitudinal members 18 with the lower flanges extending away from each other and in engagement with the lower surfaces of the side members 18 and with the upper flange members 48 extending toward each other. The side brackets 40 are connected together by a pivot element 50, the opposite ends of which are rigidly secured to the projecting end portions 53 of the web portions 44. The pivot element 50 is fastened in any conventional manner to the side brackets 40 as by nuts 52 on stud portions 54 passing through openings in the web portion 44. The pivot structure 36 can be considered a unitary member in which the Z-shaped side brackets 40 face each other and are joined together by the transverse pivot element 50.

The pivot receiving structure or connection 38 includes a pair of side brackets 60 each of which has a generally L-shaped cross section at one end, with a vertical flange 62 and a generally horizontal lower flange 64. The side brackets 60 are separately mounted on the longitudinally extending side members 18 by means of fasteners such as bolts or screws 66, so that the bottom flanges 64 engage the lower surface of the longitudinally extending side members 18 and so that the web portions 62 are disposed adjacent inwardly facing surfaces of the longitudinal members 18. Preferably a spacer member 68 is disposed between the web portion 62 and the associated side member 18 with the spacer 68 having a thickness generally the thickness of the vertical web portion 44 of the side brackets 40 on the adjoining dock section.

The side brackets 60 each form a generally circular opening 70 in the vertical web portion 62 which is open to a pair of diverging and facing cam surfaces 72 and 74 which form a pivot receiving recess 76.

The transverse pivot member 50 is generated from a member of generally circular cross section of the size of opening 70. Opposed sides of pivot member 50 are flattened as at 80 in FIG. 5 and are disposed parallel to each other with opposed upper and lower arcuate surfaces 81 being of the original circular surface.

A gap 84 is formed between the facing cams surfaces 72 and 74 of the slot 76 which merges with the opening 70. The gap 84 has a dimension conforming generally to the spacing of the parallel surfaces 80 of pivot member 50 and the opening 70 has an overall diameter slightly larger than the arcuate portions 81 of the transverse pivot member 50.

In the position shown in FIG. 2 with adjoining side sections joined together, the transverse pivot member 50 is disposed in the opening 70. As seen in FIG. 2, the vertical web portion 62 forms a projecting nose portion 86 which projects away from the opening 70 and is disposed below the upper flange 48 on the side brackets 40. The flange member 48 acts as a stop member which engages the top of the nose portion 86 to prevent the dock section 14 from pivoting in a clockwise direction as viewed in FIG. 2, from the position in which it is shown. In this manner the flange 48 and nose portion 86 act as complementary support surfaces, engagable with each other to support the adjacent dock sections relative to each other.

The usual dock installation includes a shore installation such as the shore section 12 which is permanently anchored and supported relative to the land from which the dock is to extend. The free end of the shore section supports the pivot structure 36.

Installation of the dock is initiated by placing an adjoining dock section, such as the intermediate dock section 14, with deck receiving portions facing each other and with the pivot construction 36 of the shore section 12 and the pivot receiving connection 38 of the adjoining dock section adjacent to each other. The dock section 14 including side members 18 and cross-members 20 is raised to a position in which the intermediate dock section 14 is generally vertically disposed relative to the horizontal shore section installation. In this position the gaps 84 of the side brackets 60 receive the pivot member 50 and thereafter, the dock section 14 may be pivoted from a substantially vertical position, as shown for example in broken lines in FIG. 2, to the horizontal position. In the latter position, the nose portion 86 engages the inwardly extending upper flange portions 48 of the side brackets 40 to limit pivotal movement of the dock section 14 beyond the horizontal position in which it is shown. The dock section 14 or frame portion thereof, may be permitted to pivot from the horizontal section 12 by tying a rope or line to the free end thereof, as indicated at 85 and permitting the section 14 to be lowered to the position in which it is shown in broken lines in FIG. 1.

After adjoining dock sections, such as the sections 12 and 14 are disposed in horizontal relationship to each other, a deck section 28 may be installed with the longitudinal members 24 in the notches 22, after which, a dock installer is free to walk upon the added dock section since the added dock section is supported in cantilevered relation to the initial section 12.

Disposed on the opposite sides of the added dock section 14 and adjacent its free end are a pair of outwardly disposed clamp members 89 which are adapted to receive vertical support members 90. The vertical support members 90 may be extended downwardly to engage the bottom, below the water surface, after which the clamp members 89 and support member 90 may be connected as by bolts or screws, to maintain the free end of the cantilevered section 14 supported from the water bottom. Thereafter, an additional section, such as the end section 16, may be installed relative to the intermediate section 14.

For the purpose of installing additional sections, the free end of the intermediate section 14 is provided with a pivot structure 36 and the section 16 is provided with a pivot receiving connection 38 identical to that described with respect to adjoining ends of the shore section 12 and intermediate section 14. After the end section 16 is installed, it may be supported relative to the water bottom by means of vertical members 90 in a similar manner to the intermediate section 14.

It will be understood that a number of intermediate sections 14 may be installed before the final end section 16 is installed, depending on the length of the dock which is desired. Moreover, the end section 16 need not be supported by vertical members 90, but may be left as a contilever dock section from the adjoining dock section.

Removal of the dock from the water is accomplished by attaching a line or the like, to the free end of the end dock section, removing the deck member 28 and thereafter pivoting the end dock section from its horizontal position to a vertical position as illustrated, for example, in FIG. 2. Thereafter the vertically positioned dock section may be raised vertically a slight amount so that the pivot member 50 passes through the gaps 76 and the dock sections are separated.

The separated dock section may then be carried from the remaining portion of the dock and the next section is ready for removal.

It will be noted that the dock may be installed and may be removed from a position extending over the water, from a shore installation, without the installer entering the water. In other words, all operations for installation and dismantling of the dock can be accomplished from the deck surface of the dock itself.

Referring to FIG. 6, a modified form of the invention is illustrated in which the various dock secions are fabricated of extruded aluminum material having cross sections of T-shape, channel shape and right angled shape. The dock assembly includes a shore section 100 which may be anchored in any conventional manner to the shore, one or more intermediate sections 102 and an end section 104.

In general, all of the dock sections have a pair of upper longitudinally extending stringers 106 of T-shaped cross section with the legs 107 of the T disposed to extend horizotally and toward each other at opposite sides of the dock section. Each dock section also includes a pair of lower longitudinally extending stringers 108 with a right angled cross section. The upper stringers 106 and lower stringers 108 are held in parallel spaced relationship by rectangular frames 110 made of channel shaped material and each having horizontal cross-members 111 and vertical members 112 which may also be provided with angle brackets 113 at the corners of the rectangular frame 110. The rectangular frames 110 are spaced longitudinally of the dock sections and are bolted thereto to form a generally box-like configuration.

Figure 8:
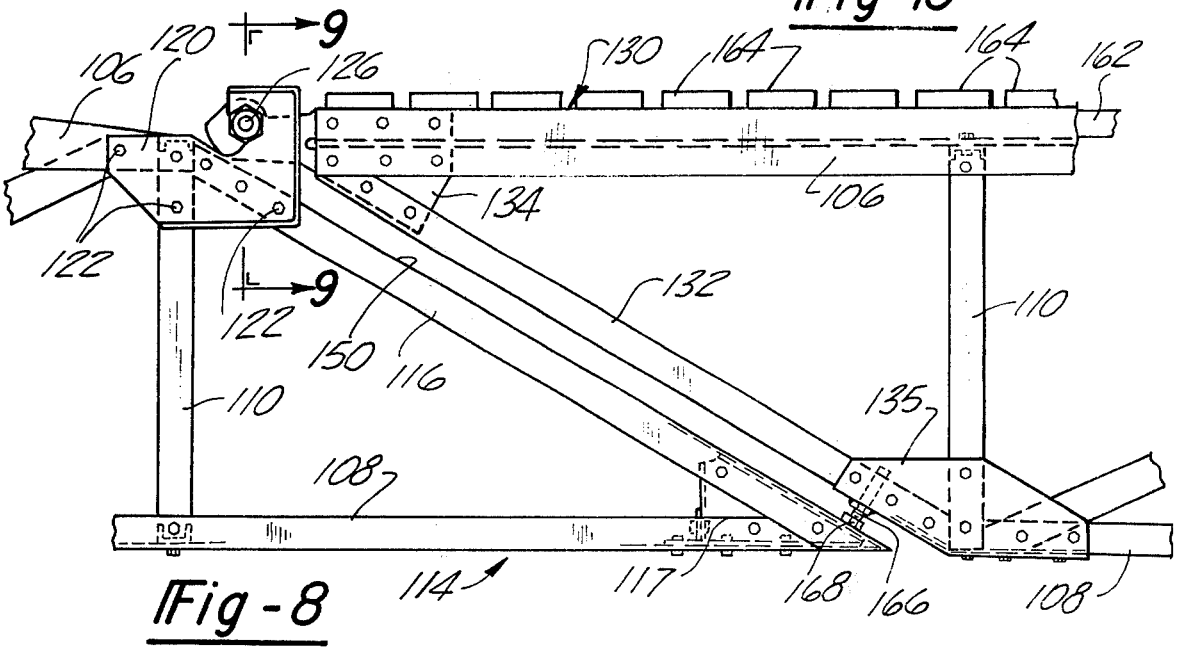
FIG. 8 is a side elevation at an enlarged scale of a portion of adjoining dock sections.

The shore section 100 has an outboard end portion designated at 114 which as best seen in FIG. 8, includes a pair of angularly disposed end pieces 116 formed of angular cross section material and sloping downwardly from the upper stringers 106 to the longer, lower stringers 108. The ends of stringers 108 are connected to end pieces 116 through means of gusset plates 117. Disposed at opposite sides of the end portion 114 of the dock section 100 is a pair of hinge or pivot structures 120 which are fastened to the outer sides of the dock section by means of bolts 122 passing through openings in the upper stringer 106, the rectangular frame member 110 and the angularly disposed end piece 116. Each of the pivot members 120 forms a semi-circular recess 124 for receiving a pivot member 126 forming part of the intermediate dock section 102. The recess 124 opens to a larger recess 128 in the pivot member 120.

As seen in FIG. 6, the intermediate dock section 102 forms an end portion 130 complementary to the end portion 114 of the shore dock section 100. The end portion 130 includes a pair of sloping members 132 which extend generally parallel to the members 116 when the dock sections are connected together, as shown in FIG. 8. The members 132 are connected to the upper stringers 106 by means of pivot structures in the form of hinge plates 134 bolted to the respective stringers 106 and members 132. The lower ends of the members 132 are connected by means of gusset plates 135 bolted to the members 132, the lower stringers 108 and a rectangular frame member 110.

As best seen in FIG. 9, the pivot structures or plates 134 at opposite sides of the dock section are connected together by the pivot members or bar 126 which includes bolt portions 136 disposed in each end of a tube 137. An outer tube 138 is disposed between the plate members 134 to maintain them in a predetermined spaced relationship and a spacer 139 is disposed on the inner tube 137 at the opposite sides of each of the plates 134. The bolts 136, the inner tube 137 and spacer tube 138 are held together by rivet 140 at each end of the assembly and nuts 141 on the bolt portions 136 serve to maintain the spacers 139 in tight engagement with the outboard sides of the bracket plates 134.

The plates 134 are each provided with a slot 142 which fits over the leg 107 at the end of the T-shaped upper stringers 106 to which the plates 134 are bolted. The plates 134 each have a projecting nose portion 144 with cam surfaces or portions 146 formed on a first radius with the pivot member 126 and a second cam surface 148 formed on a second and larger radius with the bolt member 126. The cam surfaces 146 and 148 are for a purpose to be later described Referring to FIG. 8, an adjustment screw 166 is threadably mounted in each of the sloping members 132 and each has a head portion 168 adapted to engage the corresponding upper surface of the end pieces 116 of the dock section 100. The head portions 168 and end pieces 116 form complementary load supporting surfaces which are radially spaced from the pivot element 126 and act to support and adjust the position of the dock sections 100 and 102 relative to each other. By use of the adjustment screws 166, the dock section 104 may be adjusted until it has the same horizontal attitude as the shore dock section 100.

The outboard end of the intermediate dock section 102 opposite to the pivot structure 120 on dock section 100 is formed in the same manner as the outboard end 114 of dock section 100 and includes an identical pivot structure 120. Similarly, the adjacent end of the end dock section 104 has an inboard end portion identical to the inboard end portion 130 on the intermediate dock section 102, including a pivot arrangement 126.

In the assembled condition of the dock section, the sections 100, 102 and 104 support a deck structure 160 which may be formed similarly to the deck sections 28 with longitudinal stringers 162 and wooden cross-members 164. The deck sections 160 are supported on top of each of the dock sections 100, 102 and 104 with the stringers 162 resting on the legs 107 of the T-shaped stringers 106, as seen in FIGS. 7 and 8.

Figure 12:
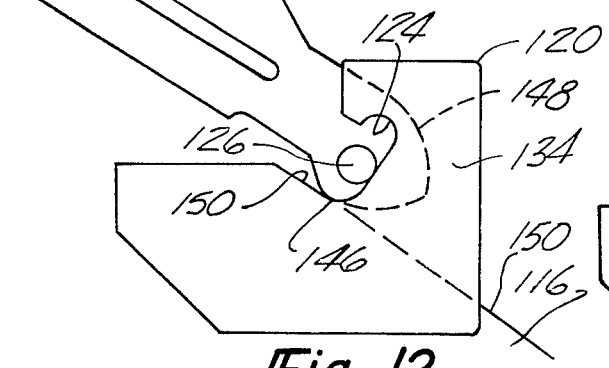
FIG. 12 is a view similar to FIG. 11 showing another adjusted position of the pivot structure.
Figure 13:
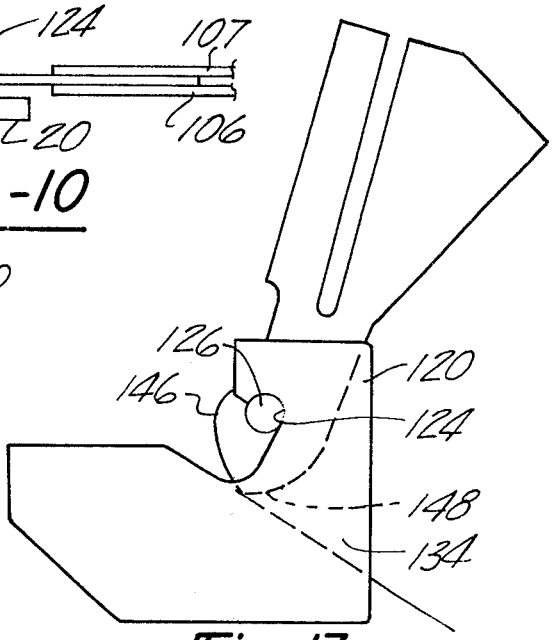
FIG. 13 is a view similar to FIGS. 11 and 12 showing still another position of adjustment of the pivot structure of the dock sections.

Erection of the modified form of the dock section shown in FIGS. 6 through 11 is generally the same as the erection of the sections 12, 14 and 16 shown in FIGS. 1 through 5. In the initial position, the shore section 100 will be provided with a deck section 160 on which a person may walk. An intermediate section 102 is positioned on the deck of the shore section 100 in an inverted position with the end portion 130 adjacent to the end portion 114, that is, with the tops of the section 100 and 102 facing each other. The end of the intermediate dock section 102 opposite to the adjacent end portions 114 and 130 is raised so that the dock section 102 is at an angle to the dock section 100 after which the dock section 102 may be moved so that the parts of adjacent dock sections assume the position shown in FIG. 12. In that position, it will be noted that the cam surface 146 is in engagement with an upper guide surface on the sloping member 116. Thereafter, the dock section 102 may be pivoted to a vertical position as shown in FIG. 13 in which the cam surface 148 comes into engagement with the top surface of the member 116. Since the cam surface 148 is on a larger radius than the cam surface 146 relative to the pivot member 126, such motion causes the pivot member 126 to move upwardly into the opening 124 as best seen in FIG. 13. Subsequently, the dock section 102 may be pivoted in a clockwise direction as seen in FIG. 13, to assume the horizontal position illustrated in FIG. 11. In that position the cam surface 148 is maintained in engagement with the guide surface 150 of the sloping member 116 and the pivot member 126 is maintained in the notch or opening 124. In such a position with both the dock sections 100 and 102 in a horizontal position, longitudinal movement of the dock section 102 is prevented by engagement of the pivot member 126 with the notch 124 to prevent displacement of the dock sections 100 and 102 relative to each other.

Figure 11:
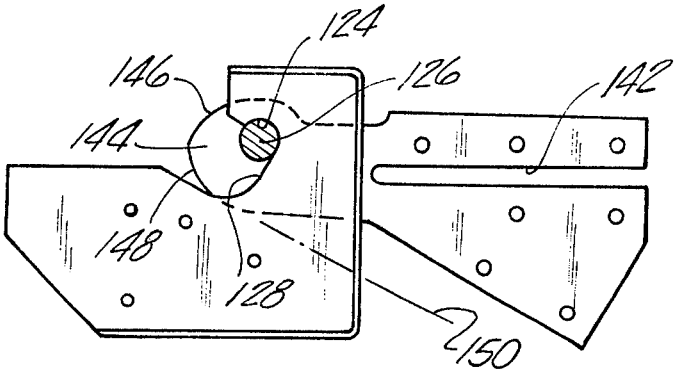
FIG. 11 is a side view at a further enlarged scale of the pivot structure of adjoining dock sections.

With the dock sections in a horizontal position and the pivot structures 120 and 126 in the position shown in FIG. 11, the dock section 102 is supported in cantilevered relationship to the dock section 100 by means of the complementary engaging surfaces formed by the head of the bolt 168 and the top surface of the sloping member 116 so that further clockwise movement of downward movement of the dock section 102 is prevented. The supporting surfaces formed by the bolt head 168 and the member 116 are disposed at substantial distance from the pivot structure 126 and 120 and affords sufficient support for the dock section 102 so that the latter is supported relative to the dock section 100 in a cantilevered relationship. Thereafter, a deck section may be slid into position onto the dock section 102 from the prior dock section, that is the shore section 100, so that a person may walk on the deck section resting on top of the dock section 102.

After a deck section has been placed on the attached dock section 102, an installer may walk to the free end of the dock section 102 and install vertical support members 90 relative to clamps 89 so that the vertical members engage the bottom beneath the water and act to support the free end of the dock section. Thereafter, an end section 104 or an additional intermediate section 102 may be attached to the installed dock section.

It will be seen that the dock sections may be used to form a dock of any desired length and that the construction lends itself also to the construction of bridges.

A portable dock of sectional construction has been provided in which dock sections may be connected to each other to make a complete dock assembly of any desired length and in which adjoining dock sections are connected together by complementary pivot members which are connected together and facilitate pivoting of one dock section relative to the other until the dock sections are in horizontally aligned relationship to each other. The pivot elements not only assist in pivoting one section relative to the other so that it is unnecessary for an installer to enter the water but also prevent longitudinal displacement of one dock section relative to another. The added dock sections are supported in cantilevered relationship to the prior dock section and if so desired vertical support means may be added to the free end of the added dock section for additional support.

The embodiments of the invention in which an exclusive property or privilege is claimed are defined as follows:

1. In a portable dock of sectional construction, the combination of; a pair of elongated dock sections, pivot means interposed between and connected to adjacent ends of said pair of dock sections for relative pivotal movement between a first position in which one of said sections is disposed at an angle to the other of said sections and a second position in which said pair of sections are disposed in longitudinal alignment with each other, said pivot means including a first pivot member connected to one of said sections and a second pivot member connected to the other of said sections, said first and second pivot members being attachable and detachable from each other when said sections are in said first position and being inseparable from each other when said sections are in said second position, said dock sections including complementary support portions disposed radially of the axis of said pivot means and being movable into engagement with each other upon movement of said sections to said second position to support one of said dock sections in cantilevered relationship to the other of said dock sections.

2. The combination of claim 1 in which one of said pivot members forms an opening and the other of said pivot members forms an axis member receivable in said opening for relative pivotal movement of said sections relative to each other.

3. The combination of claim 1 in which said first and second pivot members form surfaces interferring with each other when said dock sections are disposed in the same horizontal plane to prevent longitudinal displacement of one dock section relative to the other dock section.

4. The combination of claim 1 in which one of said pivot members forms guide means engageable with the other of said pivot members for guiding said pivot members into pivoting engagement with each other upon movement of said dock sections toward each other to said first position.

5. The combination of claim 1 in which said first pivot member is elongated and extends transversely to its associated dock section and in which said second pivot member is disposed at one side of said dock section.

6. The combination of claim 1 in which one of the support portions associated with one of said dock sections projects from the end of one of said dock sections for engagement with the other of said support portions, said other of said support portions being formed at the underside at the other of said dock sections.

7. The combination of claim 4 in which said guide means are in the form of facing cam surfaces presenting a pivot element receiving recess and a gap between said pivot receiving opening and said recess having a predetermined dimension less than the maximum dimension of said opening.

8. The combination of claim 7 in which said opening is circular and in which said pivot element has a vertical dimension corresponding to the diameter of said opening and a horizontal dimension corresponding to the predetermined dimension of said gap.

9. A hinge assembly for connecting adjoining sections of a dock or bridge to each other to dispose and support said sections in a generally horizontal plane, a first pivot member adapted to be attached to one end of a first dock section, a second pivot member adapted to be attached to an adjacent end of a second dock section, said first pivot member supporting a pivot element in transverse relation to said first dock section, said second pivot member forming an opening to receive a said pivot element for pivotal movement of said second section relative to said first section, one of said pivot members forming cam surfaces disposed radially of said pivot element associated with one of said sections and being engageable with portions associated with the other of said sections to guide said pivot element into said opening upon translational movement of adjoining dock sections relative to each other when said sections are disposed at an angle to each other, said first and second pivot members presenting complementary support surfaces engageable with each other to limit pivotal movement of said dock sections relative to each other and to maintain them in substantially the same horizontal plane with one dock section in cantilevered relationship to the other section.

10. The combination of claim 9 in which said cam surfaces face each other and form a pivot element receiving recess, said second pivot means forming a gap between said opening and said recess having a predetermined dimension less than the maximum dimension of said pivot element.

11. The combination of claim 9 in which said opening is circular and in which said pivot element has a vertical dimension corresponding to the predetermined dimension of said gap when said dock sections are disposed in horizontal relationship to each other.

12. The combination of claim 9 in which said complementary surfaces include a stop member on said first pivot means and a lever member on said second pivot means for engagement with said stop member.

13. The combination of claim 11 in which said pivot element is movable through said gap into said opening when said second dock section is in a generally vertical position relative to said first dock section and in which said pivot element is prevented from passing through said gap to prevent separation of said first and second pivot means when said adjoining dock sections are in the same horizontal plane relative to each other.

14. The combination of claim 9 in which said cam surfaces include a first cam portion on a first radius relative to said pivot element and a second cam portion on a section radius relative to said pivot element and in which said cam portions are engageable with the guide portion formed on the other of said dock sections to move said pivot element into said opening upon a change in angular position of adjoining dock sections relative to each other.

15. The combination of claim 14 in which said first cam portion slides on a guide portion on the other of said dock sections to guide said pivot element into said recess and in which said second radius is larger than said first radius so that said second cam portion moves said pivot element upwardly into said opening upon a change in angular position of adjoining dock sections.

* * * * *